US006953246B2

(12) United States Patent
Takahashi et al.

(10) Patent No.: US 6,953,246 B2
(45) Date of Patent: Oct. 11, 2005

(54) RECORDING APPARATUS

(75) Inventors: Seiji Takahashi, Kanagawa (JP); Kenji Kawazoe, Kanagawa (JP); Haruyuki Yanagi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 10/603,609

(22) Filed: Jun. 26, 2003

(65) Prior Publication Data

US 2004/0017462 A1 Jan. 29, 2004

(30) Foreign Application Priority Data

Jul. 10, 2002 (JP) ..... 2002-201762

(51) Int. Cl.[7] ..... B41J 2/01
(52) U.S. Cl. ..... 347/104; 400/613; 399/102
(58) Field of Search ..... 347/104; 400/611, 400/613, 624, 625, 629; 271/162; 399/102, 110

(56) References Cited

U.S. PATENT DOCUMENTS 5,697,022 A * 12/1997 Matsuda et al. ..... 399/102
6,099,179 A * 8/2000 Higashi et al. ..... 400/613
2004/0017459 A1 * 1/2004 Kawaguchi et al. ..... 347/104

FOREIGN PATENT DOCUMENTS

JP 2000-344377 12/2000

* cited by examiner

*Primary Examiner*—Eugene H. Eickholt
(74) *Attorney, Agent, or Firm*—Fitzpatrick, Cella, Harper & Scinto

(57) ABSTRACT

In recording on a recording medium such as a CD-R using a tray, a recording apparatus is provided, which is capable of correctly conveying the recording medium in a recording apparatus with easy operation by a simple low-cost recording construction. A tapered portion is provided at the leading end of the tray while a tray sheet, which is smaller in thickness than the tray, is stuck on the bottom surface of the tapered portion so as to protrude from the leading end of the tray in the conveying direction of the tray.

8 Claims, 22 Drawing Sheets

RECORDING APPARATUS

BACKGROUND OF THE INVENTION

1. Field of the Invention

The present invention relates to recording apparatuses such as printers, and in particular relates to a recording apparatus having a tray used in loading a small recording medium with a certain degree of thickness such as a CD-R, a DVD, and a card.

2. Description of the Related Art

Various recording media used in recording characters and images thereon by a recording apparatus such as a printer have been proposed. Those include a small recording medium with a certain degree of thickness such as a CD-R, a DVD, and a card (referred to below as a CD (compact disk) together).

If a carrier route for cut paper is used when characters or images are printed on the recording medium mentioned above by a present general-purpose recording apparatus, the recording medium may not be properly transferred because the distance to transfer rollers cannot be appropriately arranged for its high rigidity. Also a problem arises that damage is produced in the recording medium or the carrier route. Then, a recording medium with a large thickness is conveyed on a route different from that for cut paper using a dedicated tray.

The above tray is required to devise cramping means for cramping the recording medium by a pair of transfer rollers and acquiring means for acquiring a gap between a recording head and the recording medium. As one of the means, there is releasing means having a lever provided in a recording medium for releasing the pressurizing the recording medium with pinch rollers by linking it to the movement of the lever.

In such a structure, a user inserts a tray having the CD loaded thereon to a predetermined position so as to pressurizing the recording medium on the tray by operating the lever when the position has been aligned. Furthermore, the gap is ensured by elevating a carriage having a head mounted thereon using the operating lever.

As a tray used in such a recording apparatus, a construction that an end of a tray is surface-finished with a soft material is disclosed in Japanese Patent Laid-Open No. 2000-344377.

However, there have been the following problems in the conventional construction mentioned above.

When transfer members such as the pinch rollers are released by operating the lever, a transferring member need to be provided for transferring a lever operating force by connecting the transferring member to the lever. Therefore, there is a problem of increased cost due to a complicated structure.

By providing the lever, a problem of increasing the apparatus in size also arises.

Moreover, there has also been a problem that a user has to operate the lever in the recording using the tray.

If the surface of the tray is covered with a soft material such as that disclosed in Japanese Patent Laid-Open No. 2000-344377, a conveying load is increased because of the abutment between the tray and other members in the carrier route of the tray.

SUMMARY OF THE INVENTION

It is an object of the present invention to provide a recording apparatus capable of correctly conveying a recording medium to a recording position with easy operation by a simple low-cost recording construction when recording on the recording medium such as a CD-R using a tray.

A recording apparatus according to the present invention for recording images on a recording medium using a recording head comprises a tray used in mounting the recording medium thereon; a conveying roller for conveying the tray to a recording position; and a sheet member disposed at one end of the tray and being smaller in thickness than the tray. Thus at least one of surfaces of the sheet member is abutted to the conveying roller and conveyed to the recording position.

Preferably, the sheet member, which is smaller in thickness than the tray, is stuck at one end of the tray, and part of the sheet member is protruded from the one end of the tray on an upstream side of a conveying direction by conveying means while the tray itself is provided with a tapered portion formed at its one end, so that the thick tray can be securely brought into the conveying means without estranging the conveying means, thereby conveying the tray and manufacturing the structure at low cost.

Also, since the operation for estranging the conveying means is not needed, the recording on the recording medium can be performed with simple operation.

Preferably, the sheet member is further provided with an adhesive member being smaller in external size than the sheet member while being provided with a step, whereby the sheet member abuts the tray, so that the sheet member can be simply stuck with high accuracy.

Accordingly, since a plate-like thick tray can be securely conveyed with simple operation, images can be printed on a recording medium such as a CD mounted on the tray with high accuracy.

Further objects, features and advantages of the present invention will become apparent from the following description of the preferred embodiments with reference to the attached drawings.

BRIEF DESCRIPTION OF THE DRAWINGS

FIG. 6A is a perspective view of a state before the CD carrier unit is mounted on the recording apparatus; FIG. 6B is a perspective view of a state after the CD carrier unit is mounted on the recording apparatus.

FIG. 10A is a perspective view of a state before the slide cover is moved; FIG. 10B is a perspective view of a state after the slide cover is moved.

FIG. 12A is a side sectional view of a state before the slide cover is moved; FIG. 12B is a side sectional view of a state after the slide cover is moved.

FIG. 15A is a perspective view of a state before the tray sheet is stuck; FIG. 15B is a perspective view of a state after the tray sheet is stuck.

FIG. 21A is a side sectional view of a state that a carriage is descending; FIG. 21B is a side sectional view of a state that the carriage is ascending.

DESCRIPTION OF THE PREFERRED EMBODIMENTS

Next, the present invention will be described with reference to the drawings.

(First Embodiment)

Figure 1:
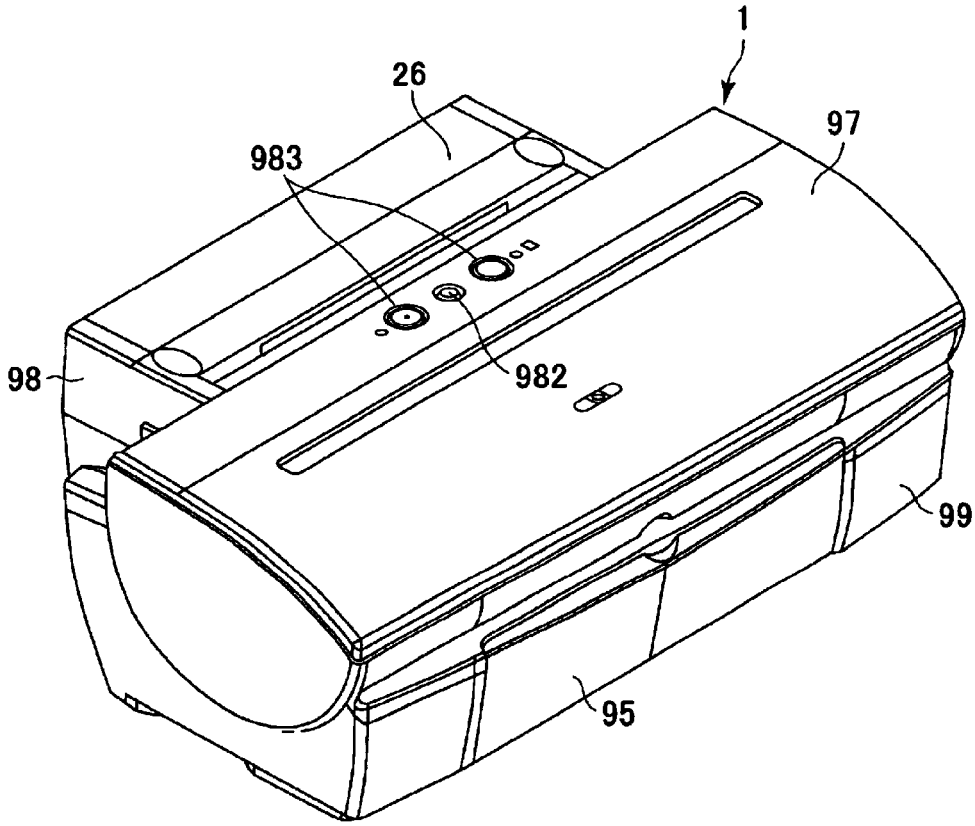
FIG. 1 is a perspective overview of a recording apparatus according to the present invention.
Figure 2:
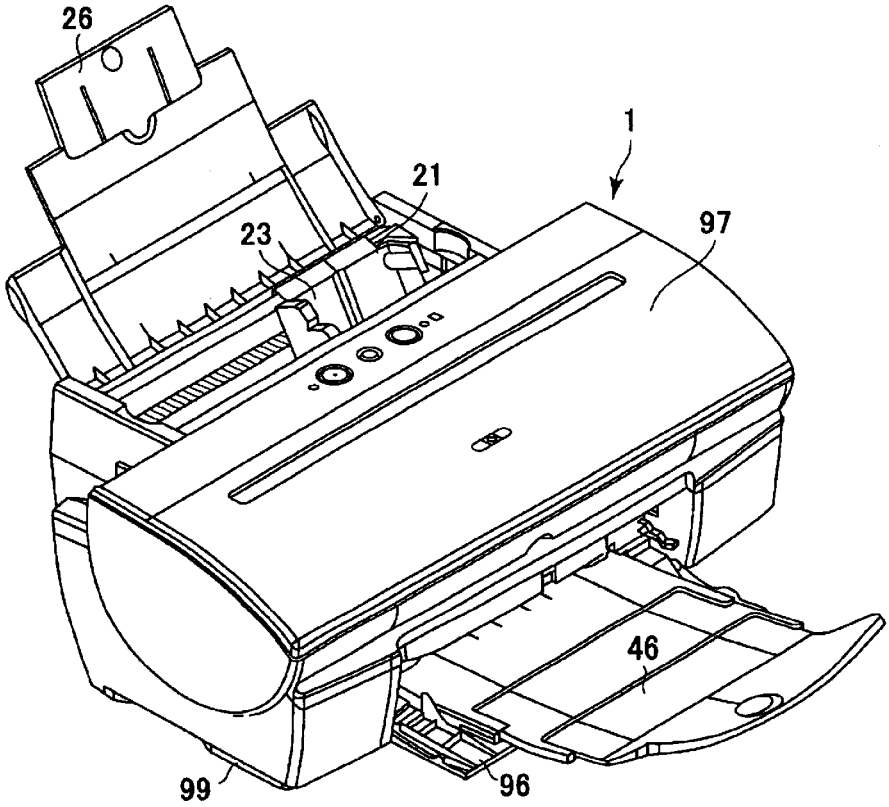
FIG. 2 is a perspective view of a feed tray and a discharge tray of the recording apparatus shown in FIG. 1 showing the trays by open the apparatus.
Figure 3:
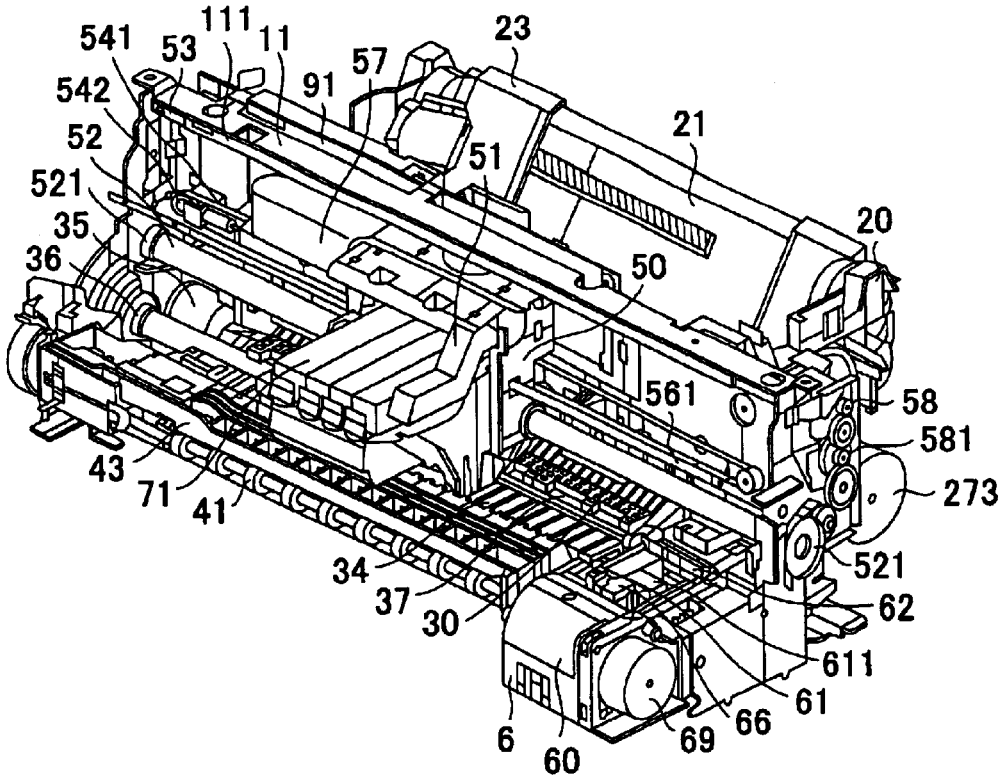
FIG. 3 is a perspective view of a mechanism of the recording apparatus according to the present invention.
Figure 4:
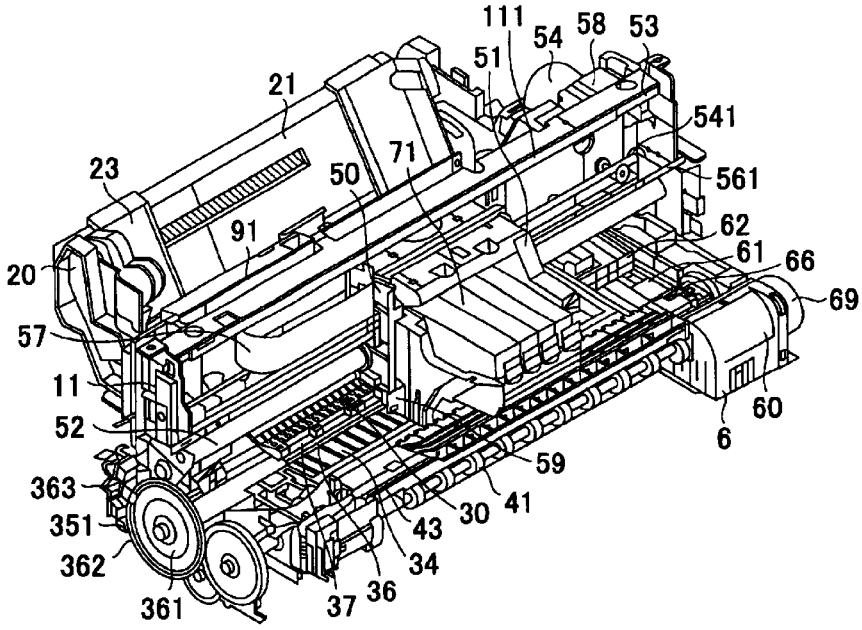
FIG. 4 is a perspective view of the mechanism of the recording apparatus according to the present invention.
Figure 5:
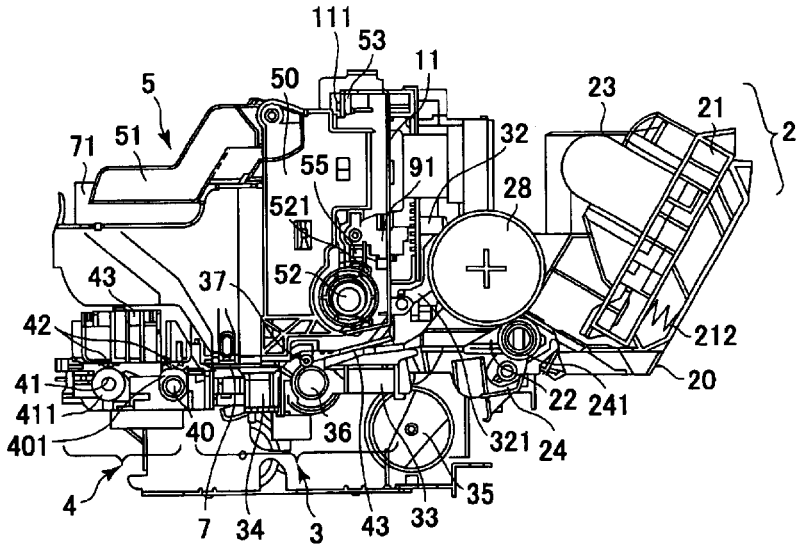
FIG. 5 is a side view of the mechanism of the recording apparatus according to the present invention.

FIG. 1 is a perspective overview of a recording apparatus according to the present invention; FIG. 2 is a perspective view of a feed tray and a discharge tray of the recording apparatus shown in FIG. 1 showing the trays by open the apparatus. FIGS. 3 and 4 are perspective views of a mechanism of the recording apparatus according to the present invention; FIG. 5 is a side view of the mechanism of the recording apparatus according to the present invention.

A recording apparatus 1 according to the present invention comprises a paper feeding section 2, a paper sending unit 3, a discharge unit 4, a carriage unit 5, a cleaning unit 6, and an armored unit, and a recording head 7 and a CD carrier unit 8 used in loading a recording medium such as a CD-R and a DVD are detachably mounted on the recording apparatus 1.

(A) Paper Feeding Section

The paper feeding section 2 comprises a pressure plate 21 used in loading a sheet member P such as cut paper thereon, a feeding roller 28 for feeding the sheet member P, a separating roller 241 for separating the sheet member P, and a return lever 22 for bringing back the sheet member P to a loading position, which are attached on a base 20.

On the base 20 or the armored unit, a feed tray 26 used in holding the loaded sheet member P is attached. The feed tray 26 is of a multistage structure, and is derived from the apparatus 1 for use during feeding the sheet member P.

The bar-shaped feeding roller 28 has a circular arc cross-section, and is provided with separating roller rubber arranged closed to a paper-reference position, thereby feeding the sheet member P into the recording apparatus 1. The driving force of the feeding roller 28 is transmitted thereto from a feeding motor 273 disposed in the paper feeding section 2 via a driving transmission gear 271 and a planetary gear 272 (both not shown).

The pressure plate 21 is provided with a movable side guide 23 movably disposed thereon, thereby restricting the loading position of the sheet member P. The pressure plate 21 is attached rotatably about a rotary shaft connected to the base 20 and urged to the feeding roller 28 by a pressure-plate leaf spring 212. The pressure plate 21 is provided with a separating sheet 213 (not shown) made of a material with a large coefficient of friction such as artificial leather for preventing double feeding the loaded sheet member P and disposed at a position opposing the feeding roller 28. The pressure plate 21 is also constructed so as to move into and out of contact with the feeding roller 28 by a pressure-plate cam 214 (not shown).

The base 20 is provided with a separating-roller holder 24 having a separating roller 241 for separating one sheet member P at a time and being attached rotatably about a rotary shaft disposed on the base 20, and the separating-roller holder 24 is urged to the feeding roller 28 by a separating-roller spring 242 (not shown).

The separating roller 241 is provided with a clutch spring 243 (not shown), and if a more load than a predetermined value is applied, a portion to which the separating roller 241 is attached is rotated. The separating roller 241 is constructed to move into and out of contact with the feeding roller 28 by a separating-roller release shaft 242 and a control cam 25 (both not shown). Positions of the pressure plate 21, the return lever 22, and the separating roller 241 are detected by an ASF sensor 29 (not shown), respectively.

The return lever 22 is rotatably attached to the base 20 for bringing back the sheet member P to the loading position, and is urged in the releasing direction by a return-lever spring 221 (not shown). The return lever 22 is rotated by the control cam 25 when the sheet member P is returned to the loading position.

The feeding procedure by the paper feeding section described above will be described below.

During normal standby, the pressure plate 21 is released with the pressure-plate cam 214; the separating roller 241 is released with the control cam 25; and the sheet member P is returned by the return lever 22 and loaded at a position that blocks the loading entrance so that the sheet member P does not enter the back. When the feeding is started from this state, the separating roller 241 first abuts the feeding roller 28 by the driving of a motor. Continuously, the return lever 22 is released so that the pressure plate 21 abuts the feeding roller 28. In this state, the feeding of the sheet member P is initiated.

Owing to the restriction of a pre-separator 201 (not shown) disposed in the base 20, a predetermined number of the sheet members P is only fed to a nip constituted of the feeding roller 28 and the separating roller 241. The sheet members P fed from the paper feeding section 2 are separated at the nip so that only the top sheet member P is transferred.

If the sheet member P arrives at a conveying roller 36 and pinch rollers 37, which will be described later, the pressure plate 21 is released with the pressure-plate cam 214; the feeding roller 28 is released with the control cam 25. The return lever 22 is also returned to the loading position by the control cam 25. At this time, the sheet members P arrived to the nip constituted of the feeding roller 28 and the separating roller 241 can be brought back to the loading position.

(B) Paper Feeding Unit

The paper sending unit 3 is attached to a chassis 11 made by cutting up a sheet metal. The paper sending unit 3 comprises the conveying roller 36 for conveying the sheet member P and a PE sensor 32 (not shown). The conveying roller 36 is made of a metallic cylinder having a surface coated with ceramic fine particles and both-end shafts journaled by bearings 38 so as to be attached on the chassis 11. In order to stably convey the sheet member P by applying a load to the conveying roller 36 during rotation, a conveying-roller tension spring is provided between the bearings 38 and the conveying roller 36 so as to urge the conveying roller 36 to the bearings 38 for applying a predetermined load.

To the conveying roller 36, a plurality of the pinch rollers 37 are abutted for following the conveying roller 36. The pinch roller 37 is held by a pinch-roller holder 30 and is pressurized to the conveying roller 36 by pinch-roller springs 31 (not shown) so as to generate a force conveying the sheet member P. Rotary shafts of the pinch-roller holder 30 are attached to bearings on the chassis 11 so as to rotate about the bearings. At the entrance of the paper sending unit 3, to which the sheet member P is fed, a paper guide flapper 33 for guiding the sheet member P and a platen 34 are arranged. Also, the pinch-roller holder 30 is provided with a PE-sensor lever 321 for transmitting detected results of the leading edge and the trailing edge of the sheet member P to the PE sensor 32. The platen 34 is positioned by attaching to the chassis 11. The paper guide flapper 33 is attached rotatably about bearings 331 (not shown) sliding by fitting to the conveying roller 36, and is positioned by abutting the chassis 11. On the downstream side of the conveying roller 36 in the conveying direction, the recording head 7 is arranged for recording images based on image information.

In the construction described above, the sheet member P fed from the paper feeding section 2 to the paper sending unit 3 is guided by the pinch-roller holder 30 and the paper guide flapper 33 so as to enter a roller pair constituting of the conveying roller 36 and the pinch roller 37. At this time, the PE-sensor lever 321 detects the leading edge of the sheet member P transferred thereto so as to obtain a recording position of the sheet member P.

The sheet member P is conveyed on the platen 34 by the rotation of the roller pair 36 and 37 due to a conveying motor 35. On the platen 34, a rib is formed as a conveying reference surface, and with this rib, a gap to the recording head 7 is controlled while a cock ring of the sheet member P is controlled together with the discharge unit, which will be described, so as not to increase the cock ring.

The conveying roller 36 is driven by transmitting the rotating force of the conveying motor 35 to a pulley 361 arranged on the shaft of the conveying roller 36 through a timing belt 351. On the shaft of the conveying roller 36, cord wheels 362 are marked at a predetermined pitch of from 150 lpi to 300 lpi, for example, and an encoder sensor 363 is attached at a position adjacent to the cord wheel 362 on the chassis 11 for reading the cord wheel 362.

In addition, as the recording head 7, an inkjet recording head having replaceable ink tanks 71 different for each color mounted thereon is used. In the recording head 7, ink is heated and film-boiled by a heater, so that ink is ejected by the growth or contraction of bubbles due to the film boiling so as to form images on the sheet member P.

(C) Carriage Unit

The carriage unit 5 comprises a carriage 50 used in detachably attaching the recording head 7 thereto. The carriage 50 is supported by a guide shaft 52 for scanning the sheet member P by reciprocating in a direction perpendicular to the conveying direction of the sheet member P and a guide rail 111 for maintaining the space between the recording head 7 and the sheet member P by holding the upper end of the carriage 50. In addition, the guide shaft 52 is attached to the chassis 11 and the guide rail 111 is made integrally with the chassis 11. On the surface of the guide rail 111 sliding with the carriage 50, a thin sliding sheet 53 made of SUS is stretched so as to reduce sliding noise.

The carriage 50 is driven by a carriage motor 54 arranged in the chassis 11 via a timing belt 541. The timing belt 541 is looped and stretched by an idle pulley 542. The timing belt 541 is connected to the carriage 50 with a rubber damper 55 (not shown) therebetween so as to stabilize the traveling by damping vibration produced by the rotation of the carriage motor 54. On the timing belt 541, in order to detect a position of the carriage 50, cord strips 561 are marked in parallel at a predetermined pitch of from 150 lpi to 300 lpi, for example. Furthermore, an encoder sensor 56 for reading the cord strip is arranged on a carriage substrate 92 (not shown) mounted on the carriage 50. On the carriage substrate 92, contacts 921 (not shown) are provided for electrically connecting to the recording head 7. Also, to the carriage 50, a flexible substrate 57 is connected for transmitting a head signal to the recording head 7 from an electrical substrate (main substrate here) 91.

In order to fix the recording head 7 to the carriage 50, the carriage 50 is provided with an abutment unit for positioning the recording head 7 and pressurizing means 511 for pressurizing and fixing the recording head 7. The pressurizing means 511 (not shown) is mounted on a head set lever 51, and it acts on the recording head 7 by rotating the head set lever 51 about its rotation support when the recording head 7 is set.

In the recording apparatus according to the embodiment, eccentric cams 521 are provided at both ends of the guide shaft 52, so that the guide shaft 52 is moved up and down by transmitting a driving force of a carriage hoisting motor 58 to the eccentric cams 521 via a gear train 581, thereby providing an optimum gap for each of the sheet members P with different thicknesses by elevating the carriage 50.

Furthermore, in the carriage 50, a tray-position detecting sensor 59 is attached, which is constituted of a reflection optical sensor for detecting a position-detection mark of a CD printing tray 83, which will be described. The tray-position detecting sensor 59 detects the position of the CD printing tray 83 by emitting light from a light-emitting element so as to receive the reflected light therefrom.

In the construction described above, in order to record images on the sheet member P, the sheet member P is conveyed to a line position (a position in the conveying direction of the sheet member P), at which an image is formed, by the roller pair 36 and 37 while the carriage 50 is moved to a row position (a position perpendicular to the conveying direction of the sheet member P), at which the image is formed, by the carriage motor 54, so that the recording head 7 is opposed to an image-forming position. Then, ink is ejected on the sheet member P from the recording head 7 in accordance with a head signal from the main substrate 91 so as to form images.

(D) Discharge Unit

The discharge unit 4 comprises two discharge rollers 40 and 41, a rotatable spur 42 following the discharge rollers 40 and 41 by abutting them with a predetermined pressure, and a gear train for transmitting a driving force of the conveying roller to the discharge rollers 40 and 41.

The respective discharge rollers 40 and 41 are attached to the platen 34. The upstream-side discharge roller 40 is a metallic shaft with a plurality of rubber portions 401 bonded thereon, and is driven by the driving force transmitted from the conveying roller via an idler gear. The downstream-side discharge roller 41 is a plastic shaft with a plurality of elastomer elastic portions 411 bonded thereon, and is driven by the driving force transmitted from the discharge roller 40 via an idler gear.

The spur 42 is an integrated product of a plastic body with a plurality of convex portions of SUS thin plates formed on the periphery of the body, and is attached to a spur holder 43. The spur 42 is fixed to the spur holder 43 with a spur spring 44 (not shown), which is a bar coil spring, while being pressurized to the discharge rollers 40 and 41. There are the spurs 42 that are respectively located at positions corresponding to the rubber portions and the elastic portions of the discharge rollers 40 and 41 for mainly generating a conveying force of the sheet member P, and that are located at positions without the rubber portions 401 and the elastic portions 411 of the discharge rollers 40 and 41 for mainly restricting the lifting of the sheet member P during recording.

In order to prevent a leading recorded portion of the sheet member P from being rubbed and damaged, a paper-end support 45 (not shown) is provided between the discharge rollers 40 and 41 for holding the sheet member P in front of the discharge rollers 40 and 41 by lifting both-side ends of the sheet member P. The paper-end support 45 comprises a plastic member having a roller disposed at its end and a paper-end support spring, and the plastic member is urged by the paper-end support spring so as to lift the both-side ends of the sheet member P by urging the roller to the sheet member P with a predetermined pressure for generating stiffness of the sheet member P.

By the structure described above, the sheet member P having images recorded thereon is conveyed through nips of the discharge rollers 40 and 41 and the spurs 42 clamping the sheet member P so as to be discharged in a discharge tray 46. The discharge tray 46 divided into a plurality of sections is accommodated in the lower portion of a lower case 99, which will be described, and is drawn when being used. The discharge tray 46 is raised at the leading end, and both-side ends are further raised, so that the loading ability of the discharged sheet members P is improved while the recorded surface is prevented from being rubbed.

(E) Cleaning Unit

The cleaning unit 6 comprises a pump 60 for cleaning the recording head 7, a cap 61 for restricting the drying of the recording head 7, and a blade 62 for cleaning surfaces of the recording head 7 in the vicinity of nozzles.

The cleaning unit 6 is provided with a cleaning motor 69 and a one-way clutch 691 (not shown) so that if the motor is rotated in one direction, the pump 60 is operated while if the motor is rotated in the other direction, the blade 62 and the cap 61 are operated.

The pump 60 is constructed such that a negative pressure is generated by bearing down on two tubes 67 (not shown) with a pump roller 68, and is connected to the cap 61 via a valve. In a state that the cap 61 is closely fitted to the recording head 7, if the pump 60 is operated, unnecessary ink is sucked from the recording head 7. The cap 61 is provided with a cap absorber 611 for reducing residual ink on the surface of the recording head 7 after the sucking. The cap absorber 611 absorbs ink remained in the cap 61 when the cap 61 is opened so as not to detrimentally stick on the recording head 7. The waste ink sucked by the pump 60 is absorbed in a waste ink absorber 991 (not shown) disposed in a lower case 99, which will be described later.

A series of operations including the operation of the blade 62 and the elevating operation of the cap 61 is controlled by a main cam 63 (not shown) having a plurality of cams disposed along a shaft. The movement of the cam and an arm disposed in each position is actuated to the main cam 63 so as to perform a predetermined operation. The position of the main cam 63 is detected by a position detection sensor 64 (not shown) such as a photo-interrupter. When the cap 61 descends, the blade 62 is moved in a direction perpendicular to the scanning direction of the carriage 5 so as to clean the surface of the recording head 7. There are plural kinds of the blades 62 provided for cleaning the vicinity of nozzles of the recording head 7 and for cleaning the entire surface of the recording head 7, for example. The ink stuck to the blade 62 itself is eliminated by abutting a blade cleaner 66 when the blade 62 is moved at a remotest position.

(F) Armored Unit

The respective units described above are assembled in the chassis 11 so as to constitute a mechanism section, and the armored unit is mounted thereon so as to cover the mechanism section. The armored unit comprises the lower case 99, an upper case 98, an access cover 97, a connector cover 96 (not shown), and a front cover 95.

In a lower portion of the lower case 99, the divided discharge trays 46 are accommodated together with a discharge tray rail. Also, a discharge exit can be closed with the front cover 95 during storing.

The upper case 98 is rotatably constructed and has the access cover 97 attached thereon. An opening is provided on part of the top surface of the upper case 98, and at the position of the opening, an ink tank 71 and the recording head 7 can be replaced by inserting into and withdrawing from the carriage 50. The upper case 98 is further provided with a door switch lever 981 (not shown) for detecting the opening and closing of the access cover 97, an LED guide 982 for transmitting and displaying light from an LED, and a key switch 983 for acting on a switch on the substrate. The multistage feed tray 26 is further attached on the upper case 98 rotatably. When the paper feeding section 2 is not used, if the feed tray 26 is stored, the feed tray 26 serves as a cover of the paper feeding section 2. The upper case 98 and the lower case 99 are connected together with elastic fitting claws, and portions between the cases where connectors are provided are covered with the connector cover 96.

Next, the CD carrier unit 8 of the recording apparatus according to the first embodiment of the present invention will be described with reference to FIGS. 6A to 22.

Figure 6A:
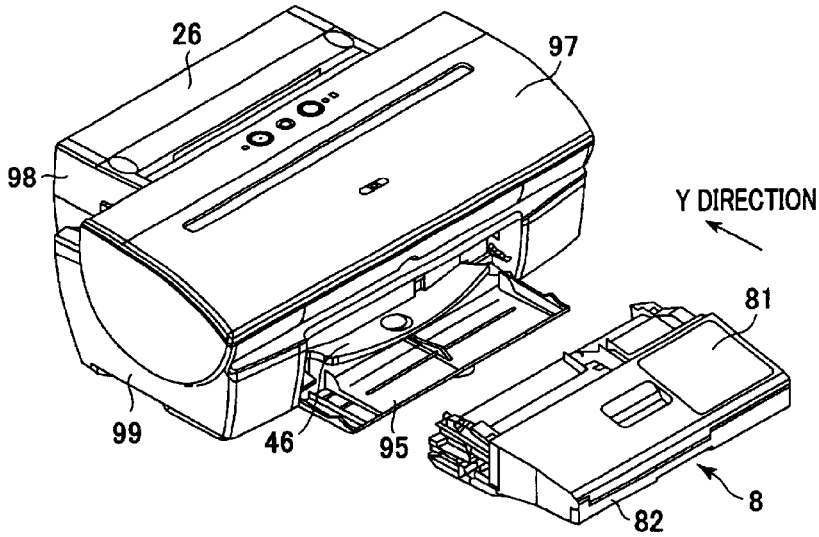
FIGS. 6A and 6B are drawings showing a structure of a CD carrier unit.
Figure 6B:
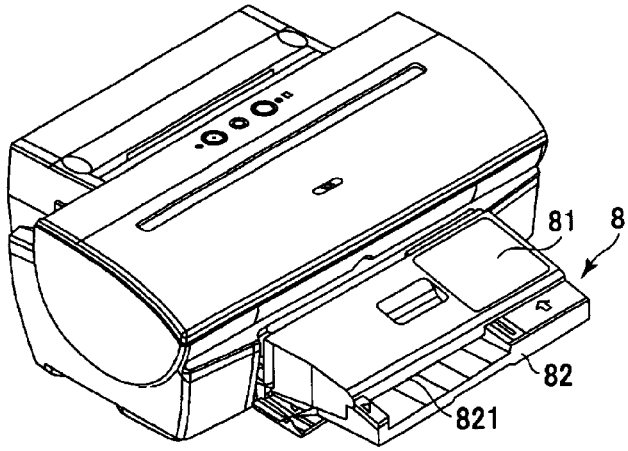
Figure 7:
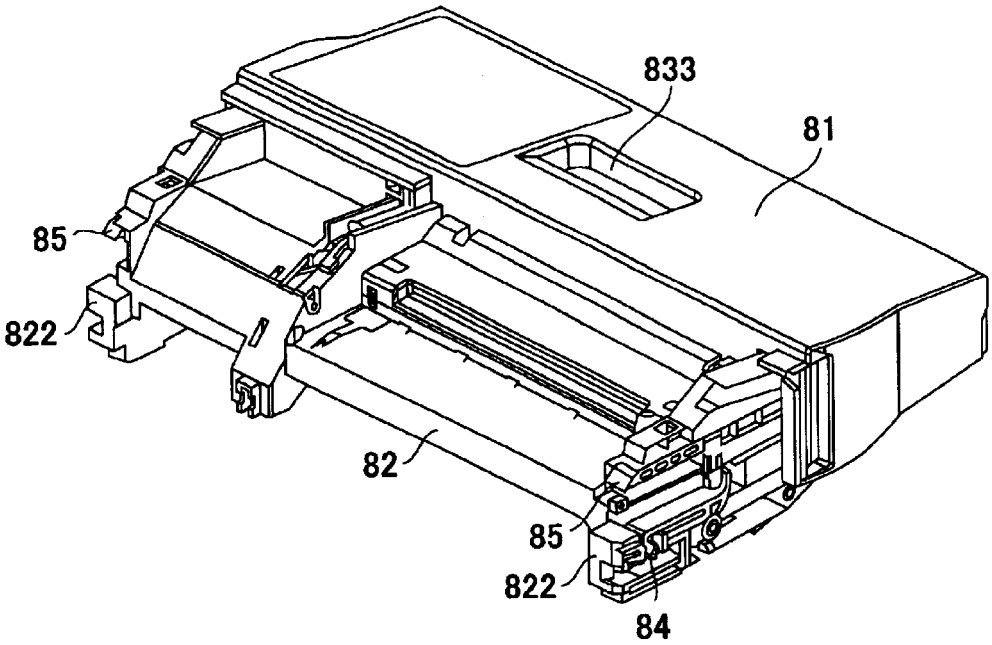
FIG. 7 is a perspective view of the CD carrier unit to be mounted on the recording apparatus according to the present invention.
Figure 8:
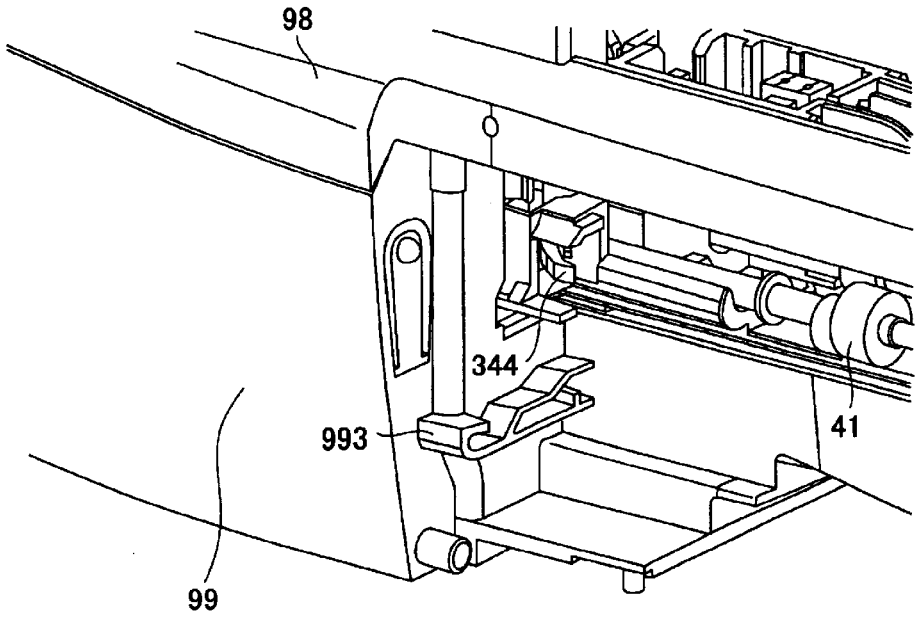
FIG. 8 is an enlarged view of an essential part of the CD carrier unit showing an attaching portion between the CD carrier unit and the lower case shown in FIGS. 6A and 6B.
Figure 9:
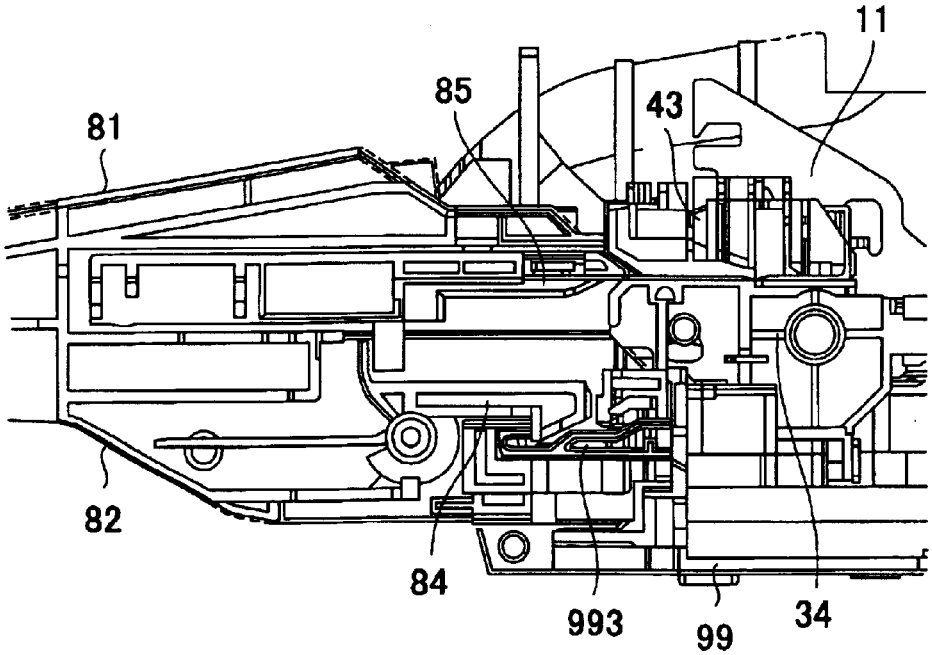
FIG. 9 is a side sectional view of hooks provided on the lower case and the CD carrier unit shown in FIGS. 6A and 6B.
Figure 10A:
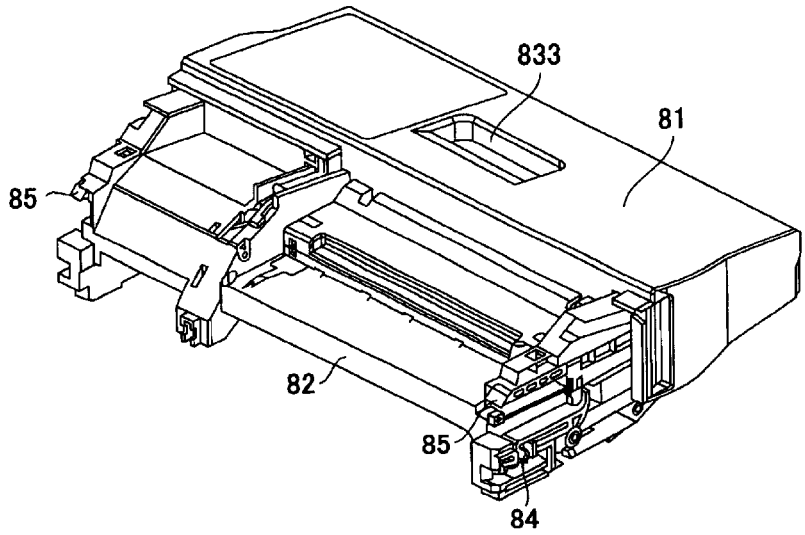
FIGS. 10A and 10B are drawings showing the operation of a slide cover provided in the CD carrier unit shown in FIGS. 6A and 6B.
Figure 10B:
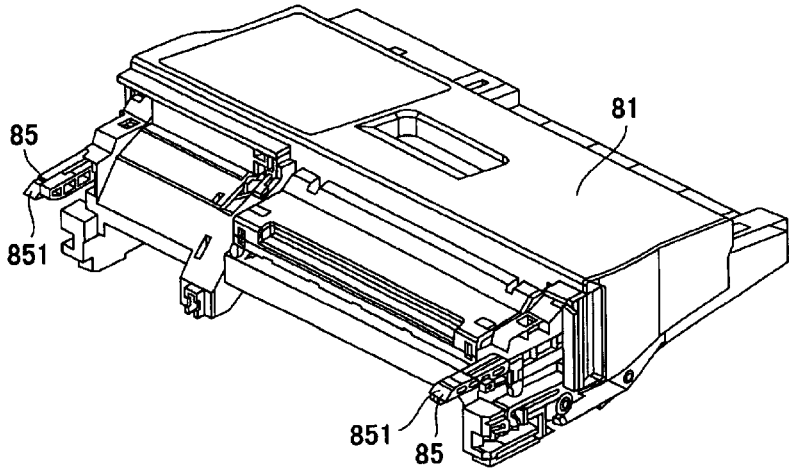
Figure 11:
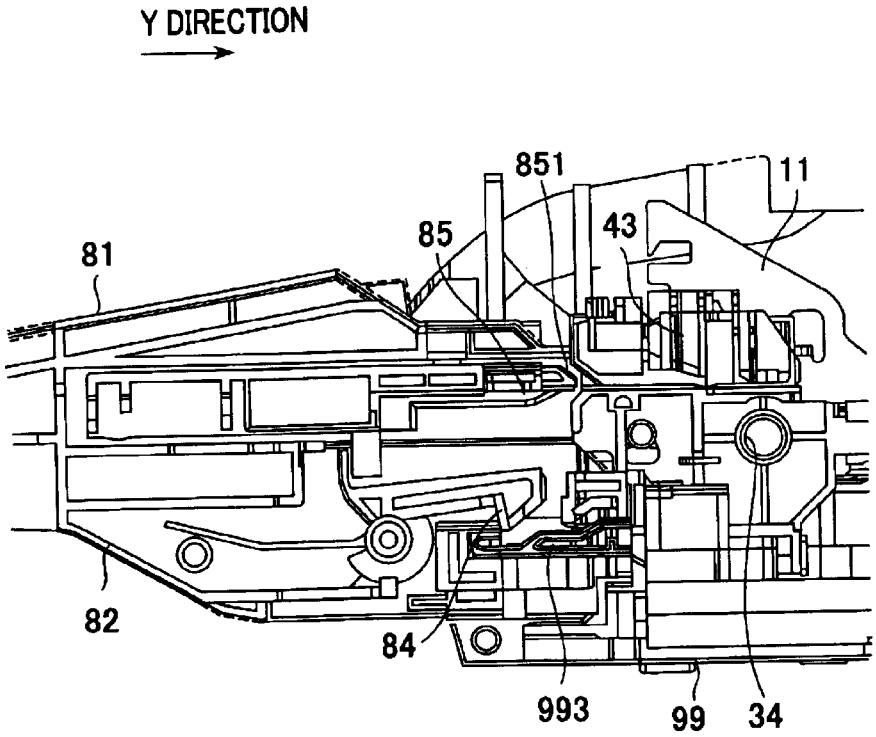
FIG. 11 is a side view of a state that the hook between the lower case and the CD carrier unit shown in FIGS. 6A and 6B is released.

FIGS. 6A and 6B are drawings showing the structure of the CD carrier unit: FIG. 6A is a perspective view of a state before the CD carrier unit is mounted on the recording apparatus; FIG. 6B is a perspective view of a state after the CD carrier unit is mounted on the recording apparatus. FIG. 7 is a perspective view showing the structure of the CD carrier unit to be mounted on the recording apparatus according to the present invention; FIG. 8 is an enlarged view of an essential part of the CD carrier unit showing an attaching portion between the CD carrier unit and the lower case 99 shown in FIGS. 6A and 6B; FIG. 9 is a side sectional view of the structure of hooks provided on the lower case 99 and the CD carrier unit shown in FIGS. 6A and 6B. FIGS. 10A and 10B are drawings showing the operation of a slide cover provided in the CD carrier unit shown in FIGS. 6A and 6B: FIG. 10A is a perspective view of a state before the slide cover is moved; FIG. 10B is a perspective view of a state after the slide cover is moved. FIG. 11 is a side view of a state that the hook between the lower case and the CD carrier unit shown in FIGS. 6A and 6B is released.

Figure 12A:
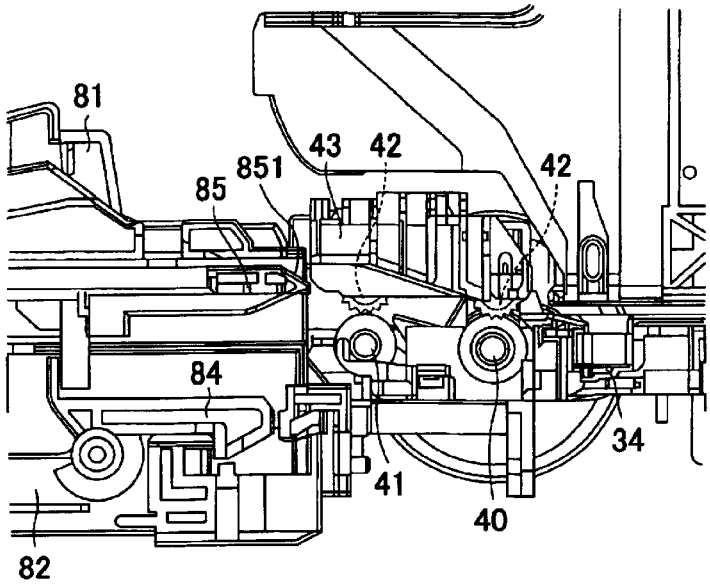
FIGS. 12A and 12B are drawings showing the operation of an arm provided in the CD carrier unit shown in FIGS. 6A and 6B liking to the slide cover.
Figure 12B:
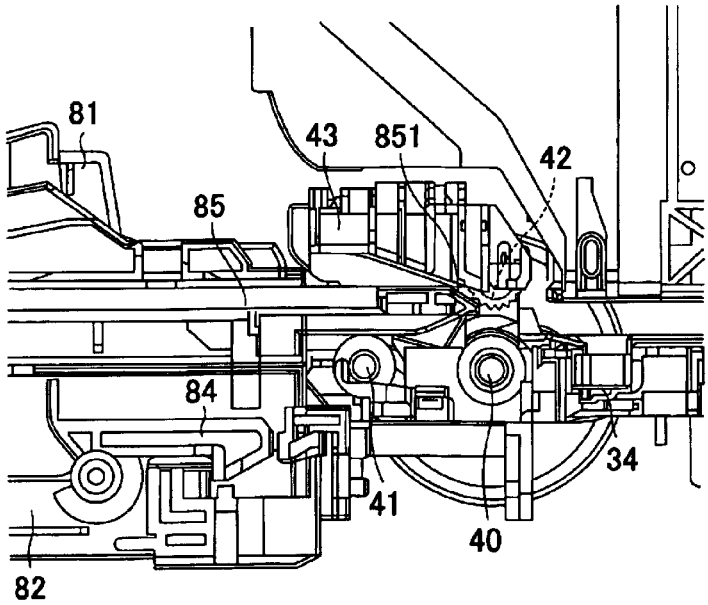
Figure 13:
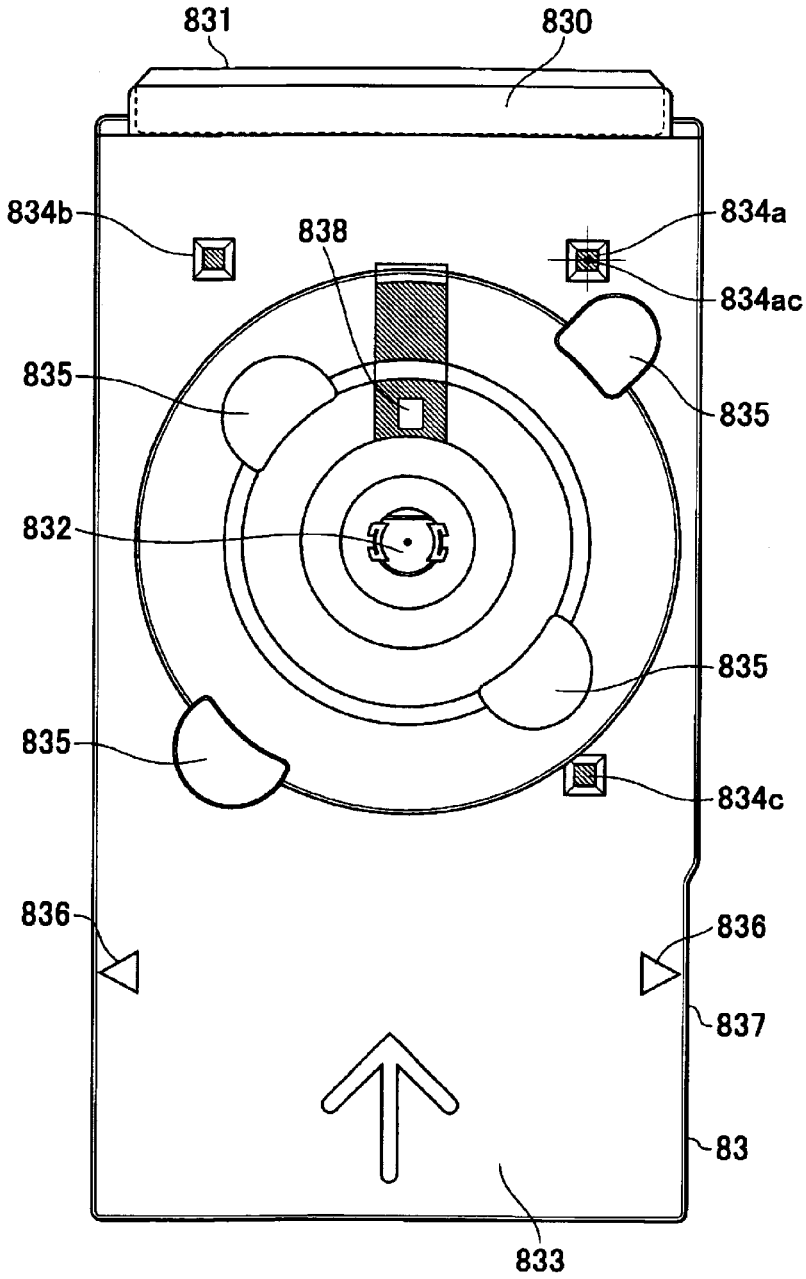
FIG. 13 is a plan view of a tray, on which the recording medium is placed.
Figure 14:
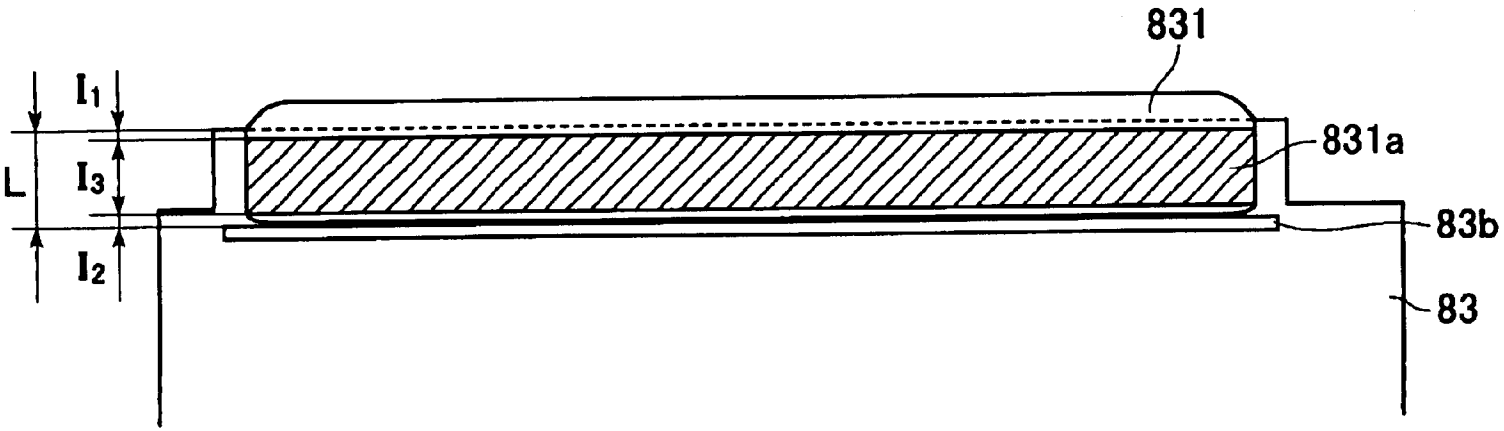
FIG. 14 is an enlarged view of an essential part of the leading edge of the tray shown in FIG. 13.
Figure 15A:
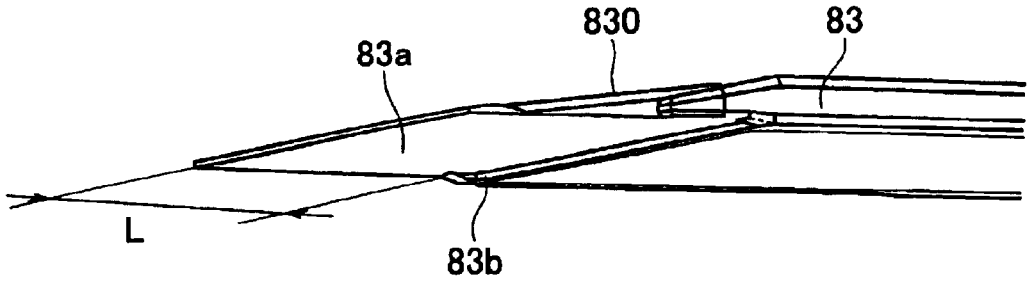
FIGS. 15A and 15B are drawings showing a state that a tray sheet is stuck at the leading edge of the tray shown in FIG. 13.
Figure 15B:
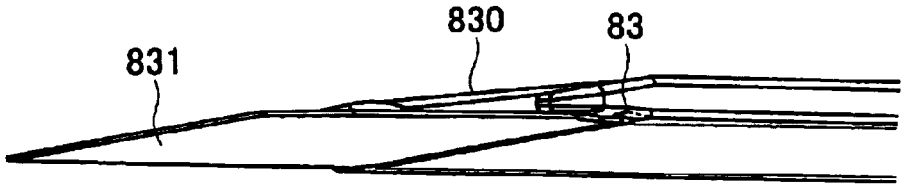
Figure 16:
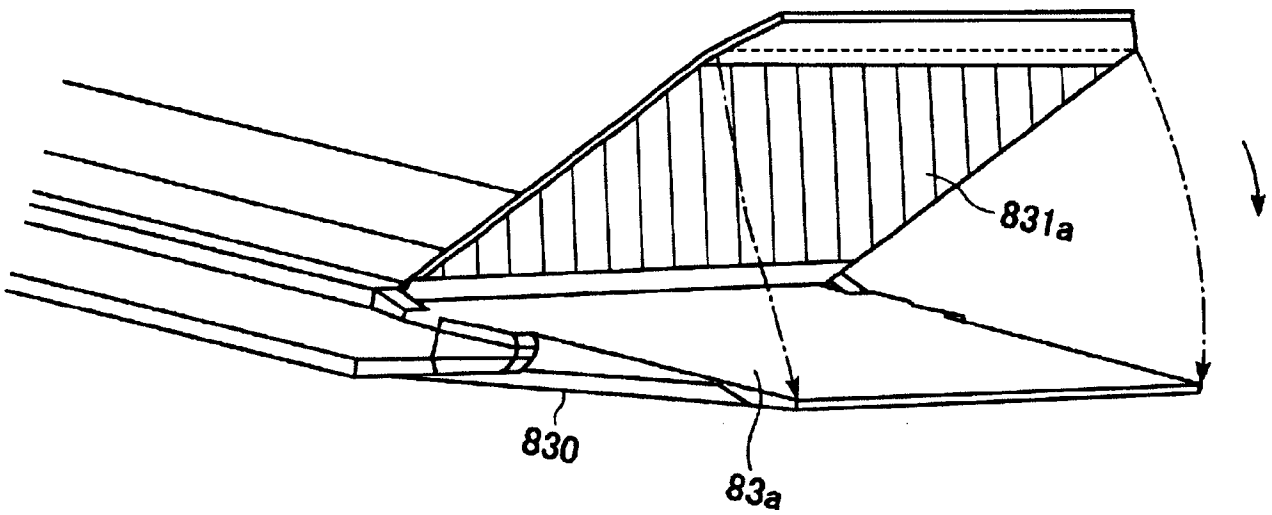
FIG. 16 is a perspective view showing a state that the tray sheet is stuck to the tray shown in FIG. 13.
Figure 17:
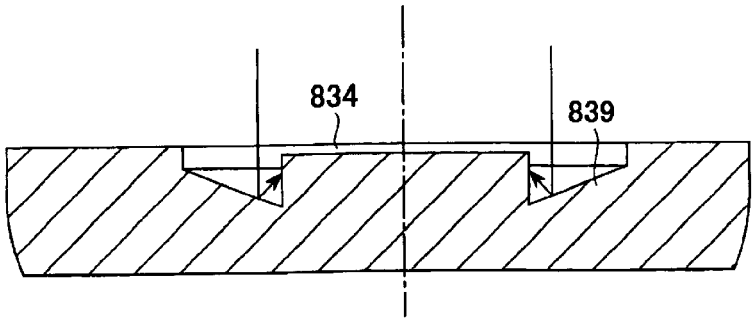
FIG. 17 is a side sectional view of the shape of a concave portion formed in the periphery of a position detection mark of the tray shown in FIG. 13.
Figure 18:
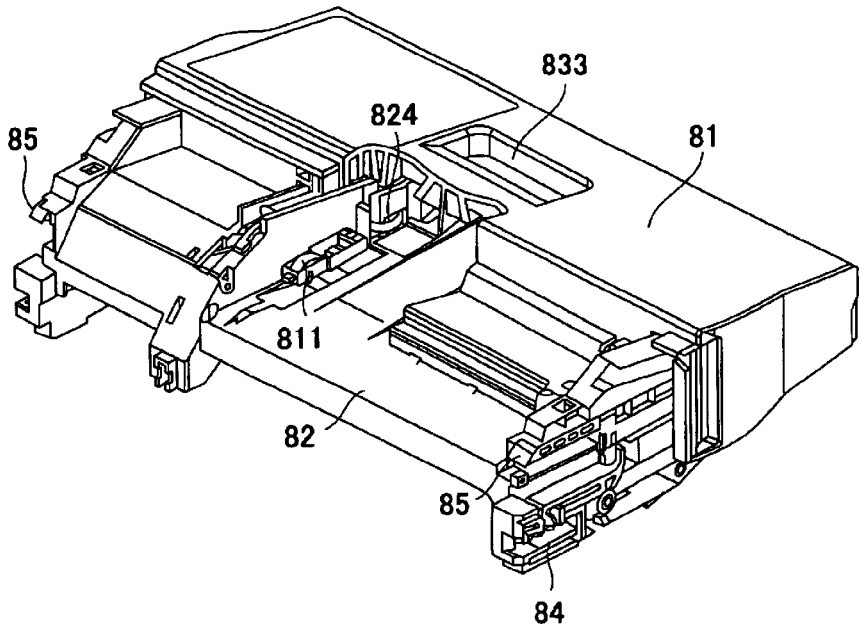
FIG. 18 is a perspective view showing the operation on the tray of a side-pressure roller and a pressurizing roller provided in the CD carrier unit shown in FIGS. 6A and 6B.
Figure 19:
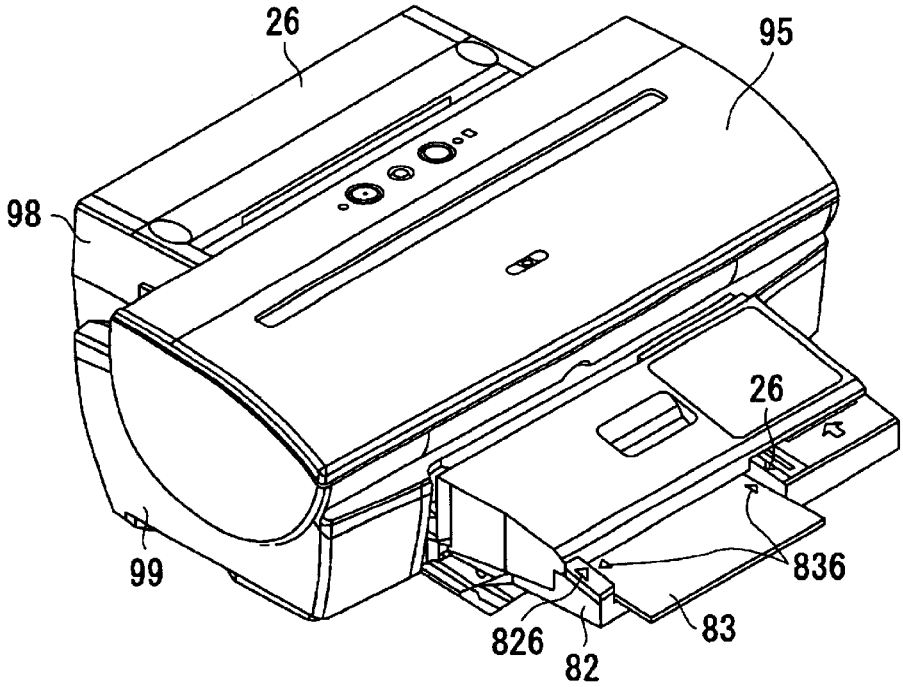
FIG. 19 is a perspective view of a state that the tray shown in FIG. 13 is set to the CD carrier unit shown in FIGS. 6A and 6B.
Figure 20:
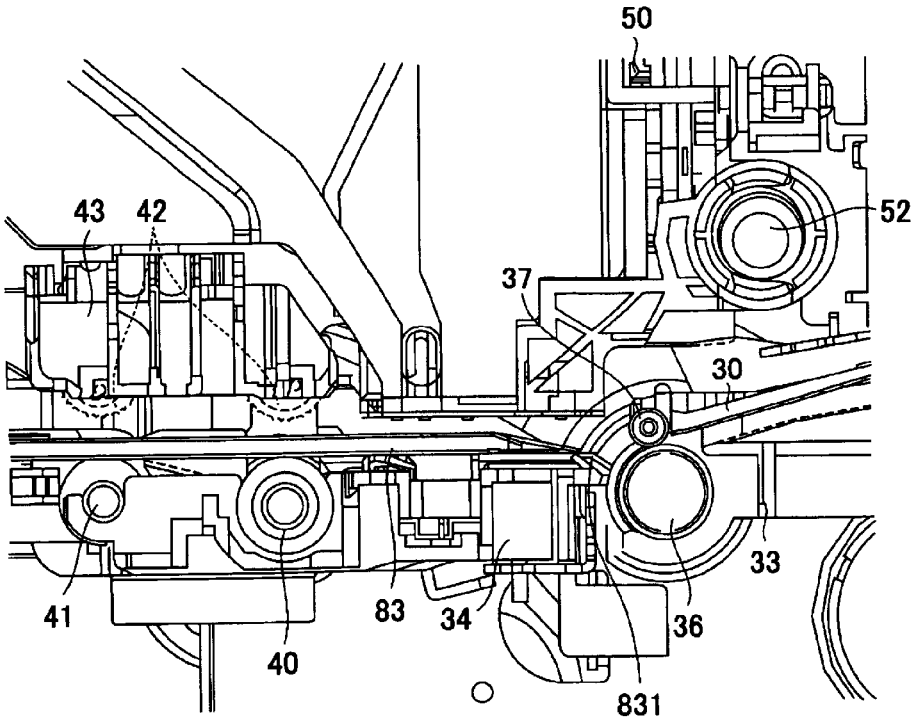
FIG. 20 is a side sectional view of a state that the tray shown in FIG. 13 is conveyed in the recording apparatus.
Figure 21A:
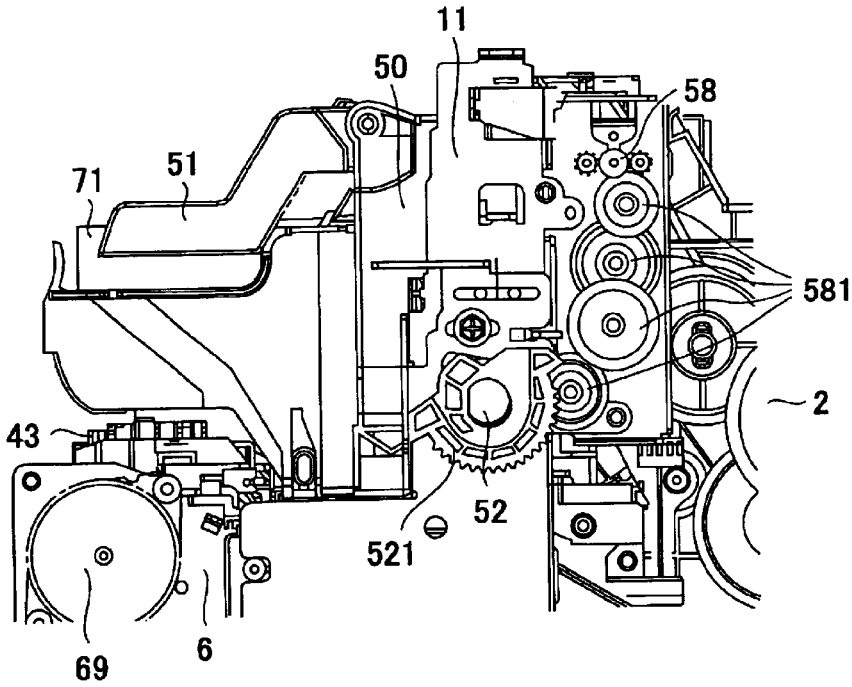
FIGS. 21A and 21B are drawings showing a state of a carriage guide shaft during conveying the tray shown in FIG. 13.
Figure 21B:
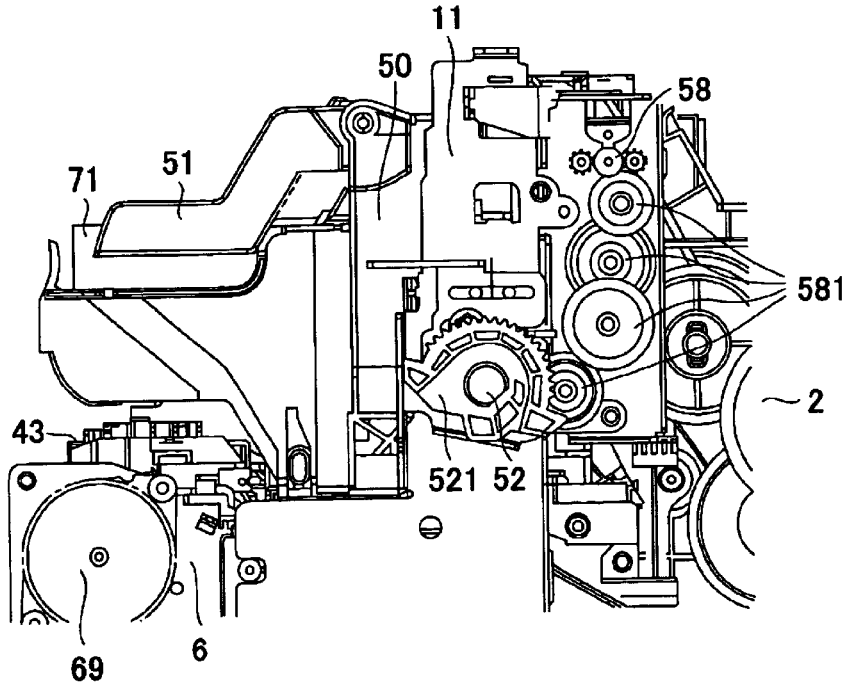

FIGS. 12A and 12B are drawings showing the operation of an arm provided in the CD carrier unit shown in FIGS. 6A and 6B liking to the slide cover: FIG. 12A is a side sectional view of a state before the slide cover is moved; FIG. 12B is a side sectional view of a state after the slide cover is moved. FIG. 13 is a plan view of the structure of a tray, on which the recording medium is placed. FIG. 14 is an enlarged view of an essential part of the leading edge of the tray shown in FIG. 13. FIGS. 15A and 15B are drawings showing a state that a tray sheet is stuck at the leading edge of the tray shown in FIG. 13: FIG. 15A is a perspective view of a state before the tray sheet is stuck; FIG. 15B is a perspective view of a state after the tray sheet is stuck. FIG. 16 is a perspective view showing a state that the tray sheet is stuck to the tray shown in FIG. 13. FIG. 17 is a side sectional view of the shape of a concave portion formed in the periphery of a position detection mark of the tray shown in FIG. 13. FIG. 18 is a perspective view showing the operation on the tray of a side-pressure roller and a pressurizing roller provided in the CD carrier unit shown in FIGS. 6A and 6B. FIG. 19 is a perspective view of a state that the tray shown in FIG. 13 is set to the CD carrier unit shown in FIGS. 6A and 6B. FIG. 20 is a side sectional view of a state that the tray shown in FIG. 13 is conveyed in the recording apparatus. FIGS. 21A and 21B are drawings showing a state of a carriage guide shaft during conveying the tray shown in FIG. 13: FIG. 21A is a side sectional view of a state that the carriage is descending; FIG. 21B is a side sectional view of a state that the carriage is ascending. FIGS. 22A to 22F are plan views showing the relationship between the tray and a tray-position detection sensor provided in the carriage, illustrating the positional detection procedures of the tray shown in FIG. 13.

As shown in FIGS. 6A and 6B, the CD carrier unit 8 is mounted on a lower case 99*b* of the recording apparatus by sliding it in the Y arrow direction of the drawing. At this time, as shown in FIGS. 8 and 9, the CD carrier unit 8 is positioned by allowing a fitting portion 822 provided on both ends of a tray guide 82 to proceed along a guide rail 993 provided in an opening of the lower case 99.

As shown in FIG. 7, at both-side ends of the tray guide 82, a hook 84 is rotatably provided and urged in one direction. When the CD carrier unit 8 is inserted to a predetermined position in the direction of the recording apparatus body, it abuts a position at that it cannot slide any more, so that the hook 84 is locked so as not to return in the reverse direction by acting on a stopper of the guide rail 993. The platen 34 is provided with a tray-guide detection sensor 344 for detecting the state that the tray guide 82 is mounted, so that if the CD carrier unit 8 is mounted on the recording apparatus, part of the tray guide 82 pushes the tray-guide detection sensor 344 so as to detect the mounting.

As shown in FIGS. 10A/10B and FIGS. 12A/12B, when a slide cover 81 is moved in the direction of the recording apparatus body in a state that the CD carrier unit 8 is mounted on the recording apparatus, an arm 85 is protruded linking to the slide cover 81. On the other hand, the spur holder 43 having the spur 42 mounted thereon is attached to the platen 34 slidably in the vertical direction, and urged by a spring with a predetermined pressure. Therefore, the arm 85 enters between the spur holder 43 and the platen 34 so as to raise the spur holder 43 by a predetermined height. At this time, since the leading edge of the arm 85 is provided with an inclined portion 851, the arm 85 can be smoothly inserted between the platen 34 and the spur holder 43. Thereby, a space can be secured such that the tray 83 can pass through between the platen 34 and the spur holder 43. The arm 85 is fixed in the state that it enters between the platen 34 and the spur holder 43, and is stored in the tray guide 82 with clearances.

In addition, in the state that the slide cover 81 is not moved in the direction of the recording apparatus body, since an opening 821 of the CD carrier unit 8 is closed, the tray 83 cannot be inserted. When the slide cover 81 is moved in the direction of the recording apparatus body, the slide cover 81 is moved in an obliquely upper direction so that the opening 821 is exposed close to the tray guide 82. In this state, the tray 83 having a CD mounted thereon as a recording medium is inserted through the opening 821 so as to set the tray 83 at a predetermined position. If the tray 83 is inserted in the state that the spur holder 43 does not ascend, the tray 83 interferes with the spur 42 so as to prevent a tray sheet 831 provided at the leading end of the tray 83 and the spur 42 from being damaged.

As shown in FIG. 11, if the slide cover 81 is slidden in a bringing direction from the recording apparatus body, i.e., in a direction reverse to the Y direction of FIG. 11, the arm 85 comes off the spur holder 43 linking to the slide cover 81, so that the spur holder 43 and the spur 42 are lowered to a predetermined position. At this time, if the tray 83 remains to be mounted in the CD carrier unit 8, the tray 83 is caught in the opening 821 between the slide cover 81 and the tray guide 82, so that the slide cover 81 cannot be brought out any more. Thereby, in the state that a CD remains in the printer body, the spur 42 is lowered so as to prevent the CD from being damaged.

Furthermore, if the slide cover 81 is slidden in a direction reverse to the Y direction, the slide cover 81 operates on the hook 84 so that the hook 84 comes off the guide rail 993 of the lower case 99 so as to release the mounting of the CD carrier unit 8 to the recording apparatus body.

Next, the tray 83 used in mounting a CD as a recording medium will be described with reference to the drawings.

The tray 83, as shown in FIG. 13, comprises a CD affixing unit 832, an operating unit 833 used by an operator to grip it when the tray is taken in and out, position detection marks 834*a* to *c*, CD taking out holes 835, insertion positional alignment marks 836, a side-pressure roller run off 837, and a media presence detection mark 838, which are mounted on a plastic plate with a thickness of about 2 mm to 3 mm. Also, at the leading end of the tray 83, the tray sheet 831 is attached to protrude from the tray 83 in the conveying direction in order to secure the pinching of the tray 83 to the conveying roller 36 and the pinch roller 37.

The tray sheet 831 is bonded to a sticking portion 83*a* on the bottom surface of a tapered portion 830 formed at the leading end of the tray 83 with a double-faced tape. The tray sheet 831 is a thin sheet with a thickness smaller than that of the leading edge of the tray 83, and is made of a base member such as PET with a thickness of about 0.1 mm to 0.3 mm having one surface coated so as to obtain a predetermined coefficient of friction and a predetermined hardness.

According to the embodiment, as a coating material for the tray sheet 831, not a material being liable to adhere such as rubber and urethane but a material having a predetermined surface roughness and a hardness larger than that of rubber and urethane is used. This is the reason that if the rubber and the urethane were used as a coating material, when a plastic member such as the paper guide flapper 33 arranged along a conveying route of the tray 83 abuts the tray sheet 831, the conveying load will be extremely increased by the adhesion to the coating material. A surface abutting the conveying roller 36 is coated with the above material, so that a conveying force can be generated sufficient to convey the tray 83 in a state abutting to the conveying roller 36.

The tray sheet 831, as shown in FIG. 14, is substantially trapezoid, and is stuck to the leading end of the tray 83 so that part of the shorter side protrudes from the tray 83. The protruding length A is about 3 mm in the conveying direction. The protruding length is set up so that when the leading end of the tray sheet 831 arrives at a nip constituted of the conveying roller 36 and the pinch roller 37, the leading end of the tray 83 cannot reach the nip. That is, the length is set so that when the leading end of the tray sheet 831 is pinched by the nip, the tray 83 does not resist the pinching. Moreover, the protruding length is set different from the length of the position detection mark 834 provided on the tray 83 in the conveying direction.

The tray sheet 831 is stuck on the entire region of the bottom surface corresponding to the tapered portion 830 formed at the leading end of the tray 83. As shown in FIG. 14, on the above-mentioned non-coated surface of the tray sheet 831, i.e., on the region corresponding to the sticking portion 83*a* in the surface abutting the pinch roller 37, a double-faced tape 831*a* is zonally provided. The width 13 of the double-faced tape 831*a* in the conveying direction is smaller than the length L of the sticking portion 83*a* in the conveying direction and the double-faced tape 831*a* is stretched along the longitudinal direction of the tray sheet 831. Also, as shown in FIG. 14, the double-faced tape 831*a* is located at a position separated from the side end of a step 83*b* provided in the tray 83 by the length 12 in the conveying direction while being located at a position separated from the leading end of the tray 83 by the length 11 in the backward direction.

In the tray sheet sticking portion 83*a* at the leading end of the tray 83, as shown in FIG. 15A, the step 83*b* is provided in the thickness direction of the tray 83, and the step 83*b* is used for positioning when the tray sheet 831 is stuck to the tray 83. That is, the tray sheet 831 can be stuck to the tray 83 at an accurate position by the abutting of the tray sheet 831 to the step 83*b*.

As shown in FIG. 16, when the tray sheet 831 is stuck to the tray 83, after the tray sheet 831 is obliquely positioned along the sticking portion 83*a* at the leading end of the tray 83 so as to abut the step 83*b* provided in the tray 83, the tray sheet 831 is positioned and bonded on the sticking portion 83*a* by falling the tray sheet 831 in the arrow direction of FIG. 16.

In such a structure, the pinching of the tray sheet 831 between the conveying roller 36 and the pinch roller 37 produces a conveying force while the raising the pinch roller 37 by the tapered portion 830 at the leading end of the tray 83 enables the thick tray 83 to be clamped by the conveying roller 36 and the pinch roller 37, enabling the tray 83 to be conveyed.

As shown in FIG. 13, the two position detection marks 834*a* and 834*b* are provided on the CD mounting surface of the tray 83 adjacent to the leading end while one position detection mark 834*c* is provided at a position opposite to these. According to the embodiment, the position detection marks 834*a* to *c* are formed like a rectangular shape of 5 mm square using a high reflectance material. Specifically they are produced using a hot stamp. In the periphery of the position detection mark 834, a concave portion 839 is provided, on which a resin reflection material is applied along the shape of the position detection mark 834.

As shown in FIG. 17, since the bottom of the concave portion 839 has a high surface nature as well as a predetermined angle, even if the light emitted from the tray-position detecting sensor 59 provided in the carriage 50 is reflected at a position other than the position detection marks 834, the light cannot return to the sensor electric eye, preventing error detection.

According to the embodiment, since the reflectance of the position detection marks 834*a* to *c* provided on the tray 83 is high, it is not necessary to provide a high-performance sensor for the positioning of the tray 83, reducing the position correction processing and preventing increased cost and the printing time. In comparison with a reading system, in which the edge of the recording region of the CD as a recording medium is directly read, even if the colored CD is used or the recorded CD is recorded again, the precise position can be detected. In addition, the position detection marks 834*a* to *c* are located at positions, at which they do not interfere with the pinch roller 37, for preventing the damage due to the abutment to the pinch roller 37 in the state that the tray 83 is inserted into the recording apparatus.

As shown in FIG. 13, a plurality of molded claws are provided in the CD affixing unit 832, thereby positioning the CD and reducing backlash during the CD mounting. When the CD is mounted on the tray 83, the CD is fixed thereto by aligning the center hole of the CD with the CD affixing unit 832. On the other hand, when the CD is dismounted from the tray 83, the CD may be taken off by gripping the peripheral edge of the CD using the two CD taking out holes 835. The CD affixing unit 832 is constructed on a surface lower than that of the tray 83, on that surface, the media presence detection mark 838 is formed. The media presence detection mark 838 is a hole with a predetermined width provided in a hot stamp, and if the hole width is detected, the absence of the media (recording medium) is determined.

As shown in FIG. 18, a side-pressure roller 824 is provided in the tray guide 82 of the CD carrier unit 8, so that the tray 83 is positioned by urging the tray 83 to a reference position with a predetermined pressure through a roller spring 825 (not shown). The side-pressure roller 824 is operated in the state that an user sets the tray 83 at a predetermined position, and during conveying the tray 83 with the conveying roller 36 and the pinch roller 37, the side-pressure roller run off 837 of the tray 83 is located in the site of action of the side-pressure roller 824. Therefore, during conveying the tray 83, the side-pressure roller 824 does not act on the tray 83, so that unnecessary back tension cannot execute the tray 83, preventing the reduction in the conveying accuracy of the tray 83.

The slide cover 81 is provided with pressurizing rollers 811 arranged in the right and the left, and by urging the tray 83 to the discharge roller 41 with a predetermined pressure through a roller spring 812 (not shown), a conveying force of the tray 83 is produced. By this conveying force, at the beginning of printing, the tray 83 is conveyed from a set position until the nip of the conveying roller 36 and the pinch roller 37, and at the completion of the printing, the tray 83 is conveyed until a predetermined taking-out position. In this case, the position detection marks 834*a* to *c* are also located at positions, at which they do not interfere with the pressurizing rollers 811, for preventing the damage due to the abutment to the pressurizing rollers 811. When the tray 83 is conveyed to the predetermined taking-out position, the tray 83 can be taken out of the tray guide 82, so that an user can take the CD out of the tray 83 using the two CD taking out holes 835.

Next, the recording operation on the recording medium by the recording apparatus constructed as described above will be described.

First, the CD carrier unit 8 is slidden in the direction of the recording apparatus body and attached to the lower case 99 of the recording apparatus. At this time, the tray-guide detection sensor 344 detects that the CD carrier unit 8 is mounted in the recording apparatus body. Furthermore, if the slide cover 81 is moved in the direction of the recording apparatus body, the arm 85 is protruded in the direction of the printer body linking to the slide cover 81, so that the arm 85 enters between the spur holder 43 and the platen 34 so as to raise the spur holder 43 by a predetermined height. When the slide cover 81 is moved in the direction of the recording apparatus body, the slide cover 81 is moved in an obliquely upper direction so that the opening 821 (see FIG. 6B) is exposed close to the tray guide 82.

In this state, an operator mounts a CD as an recording medium on the CD affixing unit 832 of the tray 83, and inserts the tray 83 through the opening 821, as shown in FIG. 19, so that the tray 83 is set at a predetermined position by pushing the tray 83 until the insertion positional alignment mark 836 is aligned with a tray set mark 826 of the tray guide 82.

Next, when the recording is started by receiving a recording signal from a computer and the like (referred to below as a host), the conveying roller 36, the discharge roller 40, and the discharge roller 41, which are shown in FIG. 20, are rotated in reverse, respectively in that order.

At this time, since the tray 83 is urged to the discharge rollers 40 and 41 with a predetermined pressure through the pressurizing rollers 811 and the roller spring 812, the tray 83 is led inside the recording apparatus by the conveying force of the rollers. Continuously, the tray 83 enters the recording apparatus by pinching the tray sheet 831 in between the conveying roller 36 and the pinch roller 37. Furthermore, the pinch roller 37 is raised by the tapered portion 830 at the leading end of the tray 83 so as to clamp the tray 83 between the conveying roller 36 and the pinch roller 37, so that the tray 83 is conveyed to the recording position.

In this state, the carriage 50 is moved from its home position to the recording position for detecting the position of the tray 83. At this time, as shown in FIG. 21B, the guide shaft 52 is raised by the driving of the carriage hoisting motor 58 so as to secure the optimum gap between the recording head 7 and the tray 83.

Figure 22A:
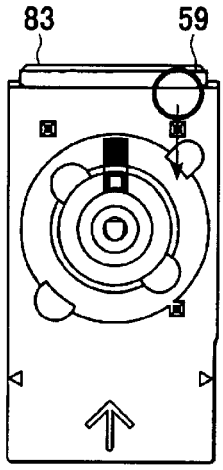
FIGS. 22A to 22F are plan views showing the relationship between the tray and a tray-position detection sensor provided in the carriage, illustrating the positional detection procedures of the tray shown in FIG. 13.
Figure 22B:
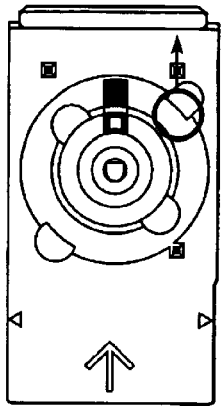
Figure 22C:
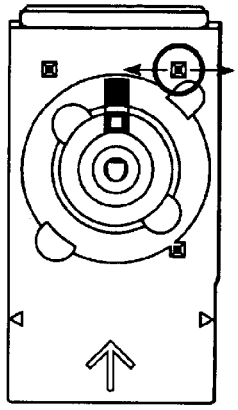

In the positional detection process of the tray 83, as shown in FIGS. 22A and 22B, first, the carriage 50 is stopped at a position where the tray-position detecting sensor 59 is aligned with the position detection mark 834*a* of the tray 83. Then, in that state, the tray 83 is conveyed; the upper edge of the position detection mark 834*a* is detected; then, the lower edge of the position detection mark 834*a* is detected. Continuously, as shown in FIG. 22C, the tray 83 is returned so that the tray-position detecting sensor 59 is located at substantially the center of the position detection mark 834*a*, and the right edge position and the left edge position of the position detection mark 834*a* are detected by moving the carriage 50 in the right and left directions, respectively.

By the above process, a central position 834*ac* of the position detection mark 834*a* is calculated, and the recording position of the CD mounted on the tray 83 is calculated from the calculated central position 834*ac*.

Since the position of the tray 83 is detected according to the method described above, the printing position cannot be displaced by variations in part accuracy and the state of the tray in comparison with a construction where the recording position is determined only by the mechanical accuracy without detection of the tray position.

Figure 22D:
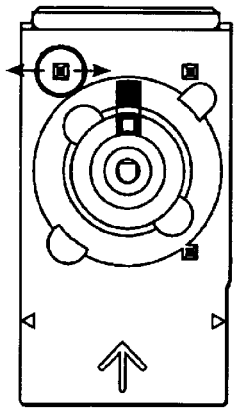

Upon completion of the detection process of the position detection mark 834*a*, as shown in FIG. 22D, the carriage 50 is moved to the position of the position detection mark 834*b*, and by conveying the tray 83 at this state, the upper edge position and the lower edge position of the position detection mark 834*b* are detected, respectively.

Figure 22E:
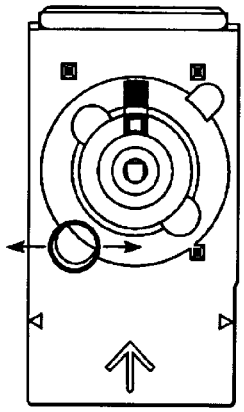
Figure 22F:
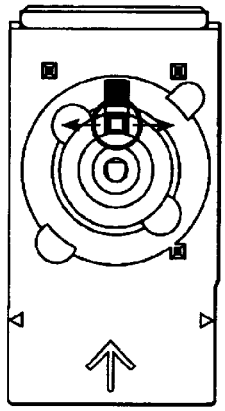

This is the process for preventing the tray 83 from being inserted further than the regular position, and if the position detection mark 834*c* is detected in advance, the position detection mark 834*b* is not detected as shown in FIG. 22E, so that the precise insertion position of the tray 83 can be determined.

If it is determined that the position detection mark 834*c* be detected in advance, the tray 83 is conveyed to a position where the tray-position detecting sensor 59 opposes the position detection mark 834*a*, and the positional detection procedure of the position detection mark 834*a* is performed again. If the position detection mark 834*a* cannot be detected at this time, the tray 83 is discharged as an error state.

Upon completion of the positional detection process of the tray 83, the tray 83 is conveyed so that the tray-position detecting sensor 59 is aligned with the media presence detection mark 838. At this time, when the edge of the detection hole of the media presence detection mark 838 is detected, if it agrees with a predetermined hole width, it is determined that a CD is not mounted, so that the tray 83 is discharged to a predetermined position so as to display error by breaking the recording. If the media presence detection mark 838 is not detected, it is determined that a CD is mounted, so that the recording is continued.

Upon completion of a series of initial operations described above, the tray 83 is conveyed to a predetermined position where the entire CD can be recorded in the back of the recording apparatus, and then the recording (printing) on the CD is started according to image data fed from the host. At this time, if a multipath method for forming images with multiple scanning is employed, the conveying accuracy is improved, so that band nonuniformity due to landing variations of ink ejected from the recording head 7 is reduced.

After the completion of the recording, the tray 83 is conveyed to the taking out position where an operator has been set the CD before the printing. In this state, the operator can take out the tray 83 having the printed CD mounted thereon. Furthermore, by sliding the slide cover 81, the arm 85 is released from the spur holder 43 and the hook 84 is released from the lower case 99, so that the CD carrier unit 8 can be taken out of the recording apparatus body.

Therefore, according to the structure of the embodiment, the tapered portion 830 is provided at the leading end of the tray 83 while the tray sheet 831, which is smaller in thickness than the tray 83, is stuck on the bottom surface of the tapered portion 830 so as to protrude from the leading end of the tray 83 in the conveying direction of the tray 83, so that the plate-like thick tray 83 can be securely brought into the conveying means without estranging the conveying means such as the pinch roller 37, thereby operating and conveying the tray 83 and manufacturing the structure at low cost. Also, since the operation for estranging the conveying means is not needed, the recording on CDs can be performed with simple operation. Furthermore, the tray sheet 831 is provided with the double-faced tape 831*a* being smaller in external size than the tray sheet 831 while being provided with the step 83*b* for positioning the tray sheet 831 at the tray 83, so that the tray sheet 831 can be simply stuck with high accuracy.

Accordingly, since a plate-like thick tray can be securely conveyed with simple operation, images can be printed on a CD or the like mounted on the tray with high accuracy.

(Second Embodiment)

In the structure according to the first embodiment, if the recording operation is instructed in the state that the tray sheet is set at a position nearer than the desired position relative to the recording apparatus body, it would appear that the carriage 50 is conveyed to a position where the tray-position detecting sensor 59 opposes the tray sheet. At this time, if the tray sheet is a material with high reflectance, the tray-position detecting sensor 59 determines the tray sheet as the positional detection mark, so that the detection processing thereafter of the positional detection mark takes a time.

In addition, according to the first embodiment, even when the tray sheet 831 is detected as the positional detection mark by mistake, since ends of the positional detection mark (the turning point from a portion with low reflectance to a portion with high reflectance) are not detected, the detection process of the positional detection mark is executed again so as to detect the position of the tray 83.

According to the embodiment, a material with reflectance lower than those of the positional detection mark and other portions is used as the tray sheet. Specifically used are black sheet resins being frosted or matt-finished and generally used for part of a shutter for cameras. If the tray sheet is made of such a material, the tray sheet cannot be detected as the positional detection mark by mistake, so that the positional detection time can be reduced, enabling the recording operation to be started within a short period of time.

In addition, the material of the tray sheet is not limited to black ones, so that an optimum material may be selected in accordance with optical characteristics of light emitted from the tray-position detecting sensor. The other structure and operation of the recording apparatus are the same as those of the first embodiment, so that the description thereof is omitted.

Therefore, according to the structure of the embodiment, by using a material with low reflectance as the tray sheet, the position of tray can be detected within a shorter period of time.

(Third Embodiment)

Figure 23:
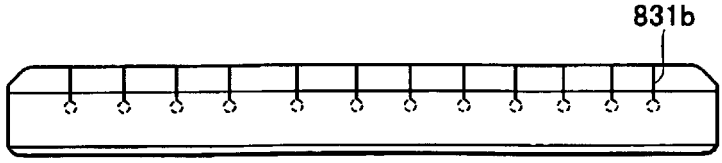
FIG. 23 is an enlarged view of an essential part of a tray sheet to be stuck to a tray according to a third embodiment in the recording apparatus according to the present invention.

FIG. 23 is an enlarged view of an essential part of a tray sheet to be stuck to a tray according to a third embodiment in the recording apparatus according to the present invention.

According to the first and the second embodiment described above, the substantially trapezoid tray sheet shown in FIG. 14 is exemplified; alternatively, as shown in FIG. 23, a structure is also preferable in that strip incisions 831*b* are formed in a region protruded from the tray.

Since the tray sheet is comparatively thin and has a thickness of 0.1 mm to 0.3 mm, it would appear the damage during handling and storing of the tray. Therefore, if the strip incisions 831*b*, shown in FIG. 23, are formed in advance, elasticity of the tray sheet is increased, suppressing the damage to the minimum. The other structure and operation of the recording apparatus are the same as those of the first embodiment, so that the description thereof is omitted.

According to the structure of the embodiment, a highly reliable tray and a recording apparatus using the tray can be provided.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for recording images on a recording medium using a recording head comprising:

a tray used in mounting the recording medium thereon;

a conveying roller for conveying the tray to a recording position; and a sheet member disposed at one end of the tray and being smaller in thickness than the tray, wherein at least one of surfaces of the sheet member is abutted to the conveying roller and conveyed to the recording position.

2. An apparatus according to claim 1, wherein the sheet member is located at a position relative to the tray, in which part of the sheet member is protruded from the one end of the tray on an upstream side of a conveying direction by the conveying roller.

3. An apparatus according to claim 1, wherein the one of surfaces of the sheet member, which abuts the conveying roller, is larger in the friction coefficient than a surface of the tray.

4. An apparatus according to claim 1, wherein the tray is provided with a step formed at one end of a portion for sticking to the sheet member, and wherein one end of the sheet member is abutted to the step and stuck to the tray.

5. An apparatus according to claim 1, wherein the sheet member comprises an adhesive member for sticking to the tray and being smaller in an external shape than the sheet member.

6. An apparatus according to claim 1, wherein the tray is provided with a tapered portion formed at one end of one surface, with abuts the conveying roller, and wherein the sheet member is stuck on the bottom surface of the surface, on which the tapered portion is formed.

7. An apparatus according to claim 1, wherein the sheet member is a material with a reflection coefficient smaller than that of the tray.

8. An apparatus according to claim 2, wherein on the sheet member, an incision is formed in parallel with the conveying direction on a region protruded from the tray.

* * * * *

UNITED STATES PATENT AND TRADEMARK OFFICE

CERTIFICATE OF CORRECTION

PATENT NO. : 6,953,246 B2
DATED : October 11, 2005
INVENTOR(S) : Seji Takahashi

It is certified that error appears in the above-identified patent and that said Letters Patent is hereby corrected as shown below:

Column 1,
Line 33, “pressurizing” should read -- pressure on --; and
Line 50, “need” should read -- needs --.

Column 2,
Line 46, “open” should read -- opening --.

Column 3,
Line 11, “liking” should read -- linking --; and
Line 61, “open” should read -- opening --.

Column 9,
Line 21, “liking” should read -- linking --; and
Line 63, “any more,” should read -- anymore, --.

Column 10,
Lines 36 and 48, “slidden” should read -- slid --; and
Line 45, “any more.” should read -- anymore. --.

Column 12,
Line 56, “an” should read -- a --.

Column 13,
Lines 13 and 32, “an” should read -- a --; and
Line 18, “slidden” should read -- slid --.

UNITED STATES PATENT AND TRADEMARK OFFICE

CERTIFICATE OF CORRECTION

PATENT NO. : 6,953,246 B2
DATED : October 11, 2005
INVENTOR(S) : Seji Takahashi

It is certified that error appears in the above-identified patent and that said Letters Patent is hereby corrected as shown below:

Column 16,
Line 2, "it would appear the damage" should read -- damage may occur --.

Signed and Sealed this

Twenty-first Day of March, 2006

JON W. DUDAS
*Director of the United States Patent and Trademark Office*